US011827025B2

(12) United States Patent
Ojima et al.

(10) Patent No.: US 11,827,025 B2
(45) Date of Patent: Nov. 28, 2023

(54) LIQUID STORAGE CONTAINER, METHOD OF MANUFACTURING LIQUID STORAGE CONTAINER, AND LIQUID EJECTING APPARATUS

(71) Applicant: CANON KABUSHIKI KAISHA, Tokyo (JP)

(72) Inventors: Masatomo Ojima, Saitama (JP); Taketsugu Murakami, Kanagawa (JP); Junichiro Iri, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 85 days.

(21) Appl. No.: 17/710,328

(22) Filed: Mar. 31, 2022

(65) Prior Publication Data

US 2022/0363066 A1 Nov. 17, 2022

(30) Foreign Application Priority Data

May 17, 2021 (JP) ..... 2021-083081

(51) Int. Cl.
*B41J 2/175* (2006.01)

(52) U.S. Cl.
CPC ..... *B41J 2/17523* (2013.01); *B41J 2/17559* (2013.01)

(58) Field of Classification Search
CPC .... B41J 2/175; B41J 2/17503; B41J 2/17506; B41J 2/17509; B41J 2/17513; B41J 2/17523; B41J 2/17559; B41J 2002/17516
See application file for complete search history.

(56) References Cited

U.S. PATENT DOCUMENTS 7,090,341 B1 * 8/2006 Miyazawa ..... B41J 2/17503 347/85
7,252,377 B2 * 8/2007 Nishioka ..... B41J 2/17523 347/7
10,000,063 B2 6/2018 Kawate et al.
2021/0370682 A1 12/2021 Murakami et al.

FOREIGN PATENT DOCUMENTS

JP 2017-113891 6/2017

OTHER PUBLICATIONS

U.S. Appl. No. 17/829,701, filed Jun. 1, 2022.

* cited by examiner

*Primary Examiner* — Anh T Vo
(74) *Attorney, Agent, or Firm* — Venable LLP

(57) ABSTRACT

A liquid storage container is configured to supply a liquid containing a precipitating component to a liquid ejecting apparatus, including: a partitioning member configured to divide a liquid storage chamber in a direction intersecting a direction of gravitational force; a plurality of liquid storage chambers divided by the partitioning member; and communication flow channel units provided to the plurality of liquid storage chambers, respectively, and configured to introduce the liquid in the liquid storage chambers and to supply the liquid to the liquid ejecting apparatus.

10 Claims, 13 Drawing Sheets

LIQUID STORAGE CONTAINER, METHOD OF MANUFACTURING LIQUID STORAGE CONTAINER, AND LIQUID EJECTING APPARATUS

BACKGROUND OF THE INVENTION

Field of the Invention

The present disclosure related to a liquid storage container used in a liquid ejecting apparatus that ejects a liquid.

Description of the Related Art

A liquid storage container for supplying a liquid to a liquid ejecting apparatus has been known. In a case where a liquid containing a precipitating component is stored in the liquid storage container, the concentration of the liquid in the liquid storage container may become non-uniform due to precipitation of the precipitating component.

Japanese Patent Laid-Open No. 2017-113891 discloses a technique for supplying a liquid having a uniform concentration of a precipitating component to a liquid ejecting unit by locating a first liquid sucking portion at a lower end on a gravity direction side of a liquid containing portion, and locating a second liquid sucking portion on an anti-gravity direction side thereof.

However, if the liquid storage container is left to stand in the same position for a long time in a state of long-term storage or in a long-term unused state, precipitation in the liquid may develop further at a lower layer portion in the liquid storage container. Moreover, the liquid increased in concentration may reduce its fluidity and complicate stable supply of the liquid at a uniform concentration.

An object of the present disclosure is to provide a liquid storage container which supplies a liquid stably at a uniform concentration.

SUMMARY OF THE INVENTION

A liquid storage container according to one aspect of the present disclosure is configured to supply a liquid containing a precipitating component to a liquid ejecting apparatus, including: a partitioning member configured to divide a liquid storage chamber in a direction intersecting a direction of gravitational force; a plurality of liquid storage chambers divided by the partitioning member; and communication flow channel units provided to the plurality of liquid storage chambers, respectively, and configured to introduce the liquid in the liquid storage chambers and to supply the liquid to the liquid ejecting apparatus.

Further features of the present invention will become apparent from the following description of exemplary embodiments with reference to the attached drawings.

DESCRIPTION OF THE EMBODIMENTS

Preferred embodiments of the present disclosure will be described below in detail with reference to the accompanying drawings. Note that the following embodiments are not intended to limit the subject matter of the present disclosure. It is to be also understood that a solution according to the present disclosure does not always require a combination of all of the features described in any of the embodiments.

First Embodiment

<Liquid Ejecting Apparatus>

Figure 1:
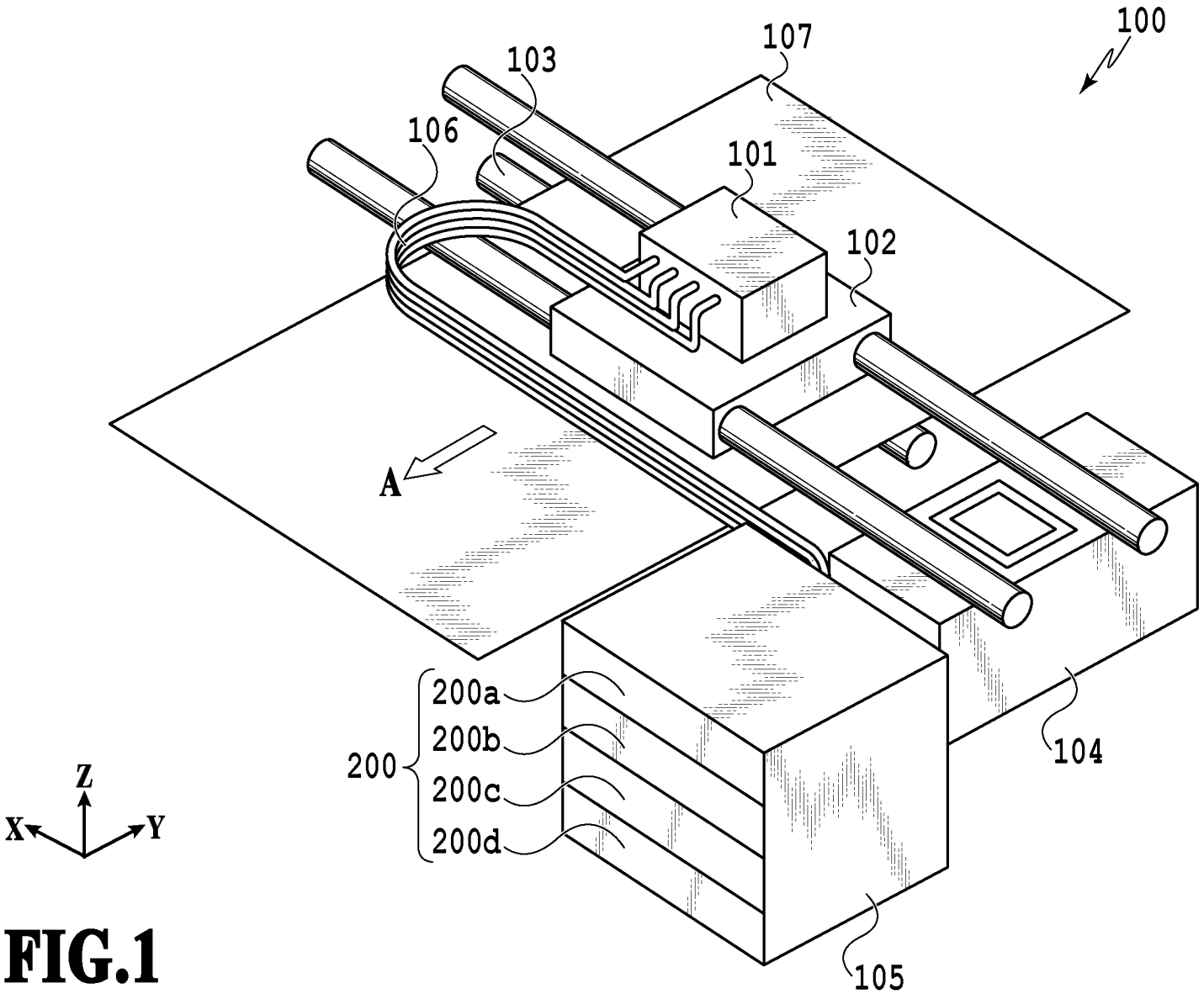
FIG. 1 is a perspective view showing a schematic configuration of a liquid ejecting apparatus.

FIG. 1 is a perspective view showing a schematic configuration of a liquid ejecting apparatus 100 according to the present embodiment. The liquid ejecting apparatus 100 shown in FIG. 1 repeats reciprocation of a liquid ejecting head 101 and conveyance at a predetermined pitch of a print sheet 107 serving as a print medium. The liquid ejecting apparatus 100 can form characters, symbols, images, and the like by selectively ejecting inks (liquids) of several colors from the liquid ejecting head 101 synchronously with these movements and causing the inks to land on the print sheet 107 serving as the print medium. Here, any print material may be used as the print sheet 107 as long as the print material allows landing of droplets of the liquid to form an image. Materials of various qualities and forms such as paper, cloths, optical disc label surfaces, plastic sheets, OHP sheets, and envelops can be used as the print medium.

In FIG. 1, the liquid ejecting head 101 is detachably mounted on a carriage 102 which is slidably supported by two guide rails and reciprocated on a straight line along the guide rails by use of a not-illustrated driving unit such as a motor. The print sheet 107 that receives the liquids ejected from liquid ejecting units of the liquid ejecting head 101 is opposed to a liquid ejecting surface of the liquid ejecting head 101 and conveyed in a direction intersecting with a direction of movement of the carriage 102 by using a conveyance roller 103 serving as a conveyance unit.

The liquid ejecting head 101 includes multiple nozzle rows for ejecting the liquids of colors different from one another as the liquid ejecting units. Multiple independent liquid storage containers 200 each including a liquid supply port 17 (see FIG. 3) and corresponding to the color of the liquid to be ejected from the liquid ejecting head 101 are detachably attached to a liquid supply unit 105. In the present embodiment, liquid storage containers 200*a*, 200*b*, 200*c*, and 200*d* are attached to the liquid supply unit 105, respectively. In the following description, the liquid storage container 200 will represent an arbitrary one of the liquid storage containers 200*a* to 200*d*.

The liquid supply unit 105 is connected to the liquid ejecting head 101 by using multiple liquid supply tubes 106 corresponding to the colors of the liquids, respectively. The liquids of the respective colors stored in the liquid storage containers 200 can be independently supplied to the respective nozzle rows of the liquid ejecting head 101 by attaching the liquid storage containers 200 to the liquid supply unit 105.

A recovery unit 104 is disposed face to face with the liquid ejecting surface of the liquid ejecting head 101 in a non-ejection region, which is a region in a range of reciprocation of the liquid ejecting head 101 and out of a range of passage of the print sheet 107. The recovery unit 104 includes a cap portion for capping the liquid ejecting surface of the liquid ejecting head 101, a suctioning mechanism for forcibly suctioning the liquid in a state of capping the liquid ejecting surface, a cleaning blade for wiping stains off the liquid ejecting surface, and the like. A suctioning operation is carried out prior to an ejecting operation of the liquid ejecting apparatus 100. In this way, it is possible to remove bubbles remaining in the liquid ejecting units and a viscous liquid near ejecting ports in the liquid ejecting head 101 by causing the recovery unit 104 to carry out recovery processing even in a case where the liquid ejecting apparatus 100 is operated after leaving the apparatus to stand for a long time. Thus, ejection characteristics of the liquid ejecting head 101 are maintained.

In the present embodiment, a direction of attachment and detachment of each liquid storage container 200 to and from the liquid supply unit 105 is defined as y direction. An end of the liquid storage container 200 to be attached to the liquid supply unit 105 is defined as +y direction. A width direction of the liquid storage container 200 is defined as x direction. A height direction (that is, a direction of gravitational force) of the liquid storage container 200 is defined as z direction. Here, a gravity side (a lower side) is defined as −z direction while an anti-gravity side (an upper side) is defined as +z direction.

Figure 2:
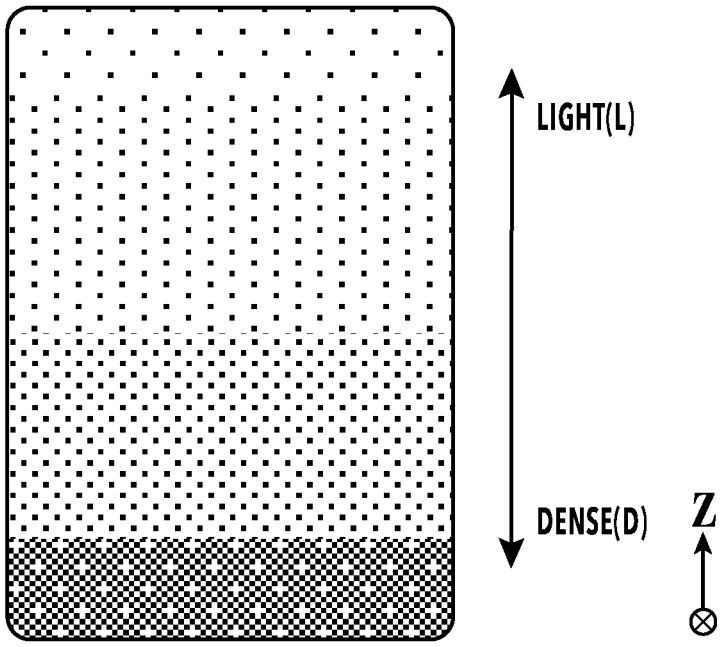
FIG. 2 is a diagram showing concentration distribution of a liquid.

FIG. 2 is a diagram showing concentration distribution of a liquid in the present embodiment. The present embodiment will describe an example in which the liquid stored in each liquid storage container is an ink that contains a pigment coloring material being a precipitating component and a liquid medium used for dispersing this precipitating component. In the case where the liquid storage container is left to stand in the same position for a long time, the coloring material precipitates due to an effect of the gravitational force because a molecular weight of the pigment is larger than that of a dye. A phenomenon that the concentration of the coloring material in the liquid storage container becomes non-uniform occurs in this case. Although the concentration distribution is illustrated in a stepwise manner in FIG. 2, the actual concentration distribution shows a continual change. If the concentration of the precipitating component is inhomogeneous as shown in FIG. 2, the liquid ejecting unit may fail to eject the liquid at the uniform concentration. In the meantime, if the liquid storage container is left to stand in the same position for a long time in a state of long-term storage or in a long-term unused state, the precipitation of the liquid may progress further at a lower layer portion of the liquid storage container. The liquid increased in concentration reduces its fluidity and may complicate stable supply of the liquid at the uniform concentration. The liquid storage container 200 of the present embodiment is configured to be capable of supplying the liquid at the uniform concentration in the case of Using the Liquid Containing the Precipitating Component as Mentioned Above.

<Liquid Storage Container>

Figure 3:
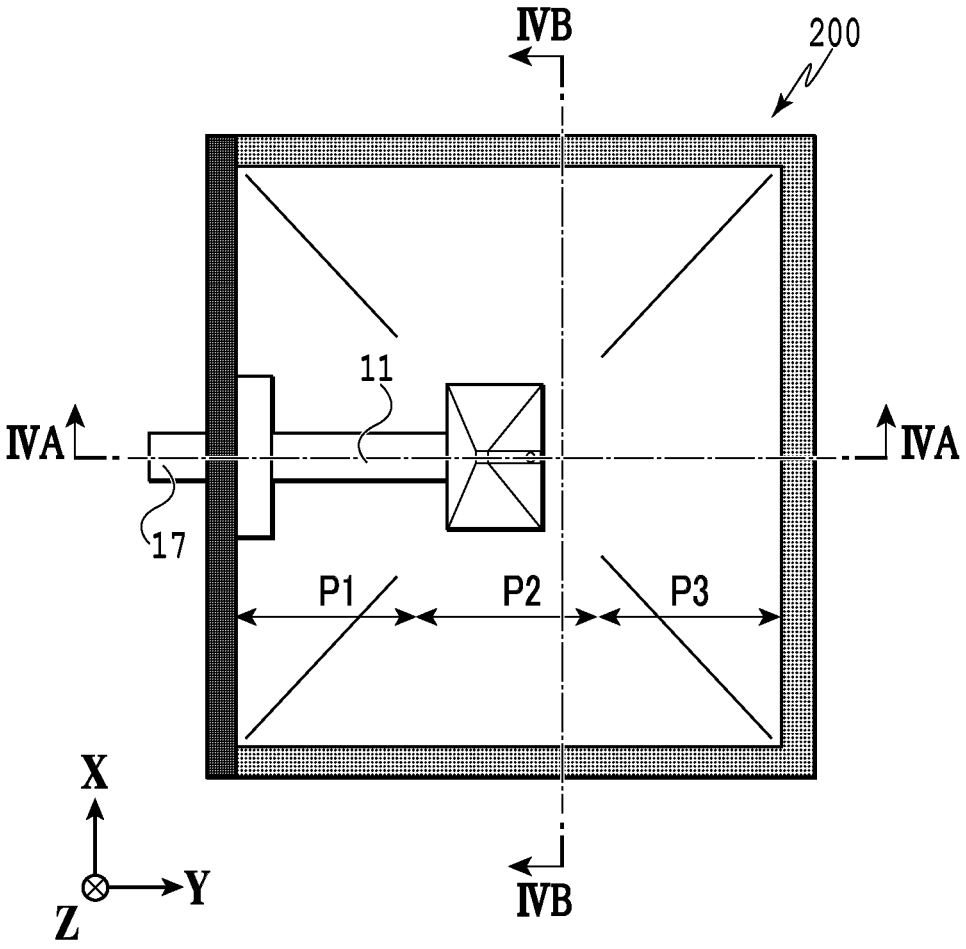
FIG. 3 is a plan view showing a configuration of a liquid storage container.
Figure 4A:
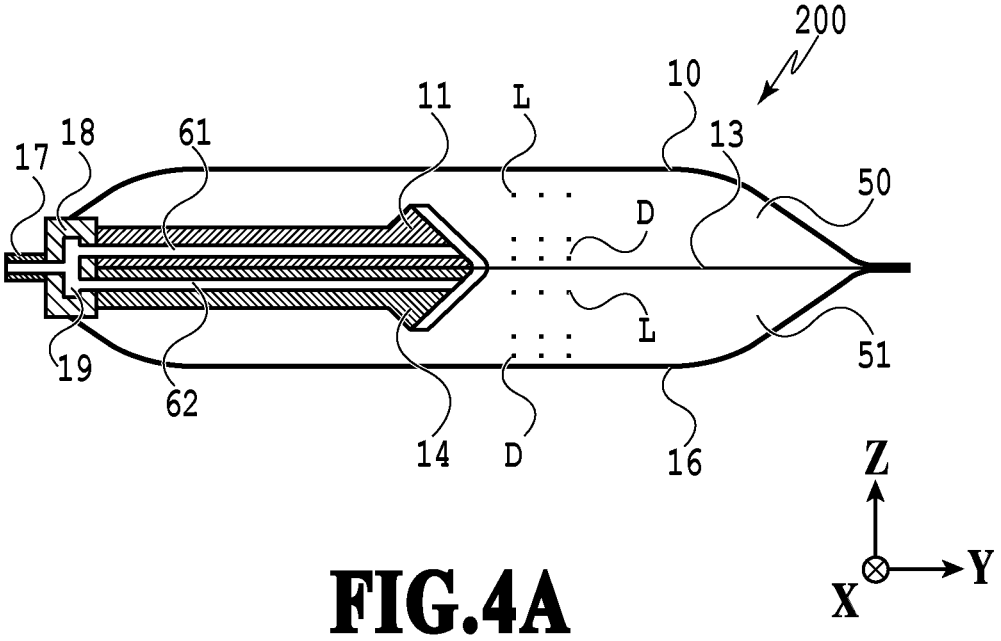
FIGS. 4A and 4B are diagrams each showing a cross-section of the liquid storage container.
Figure 4B:
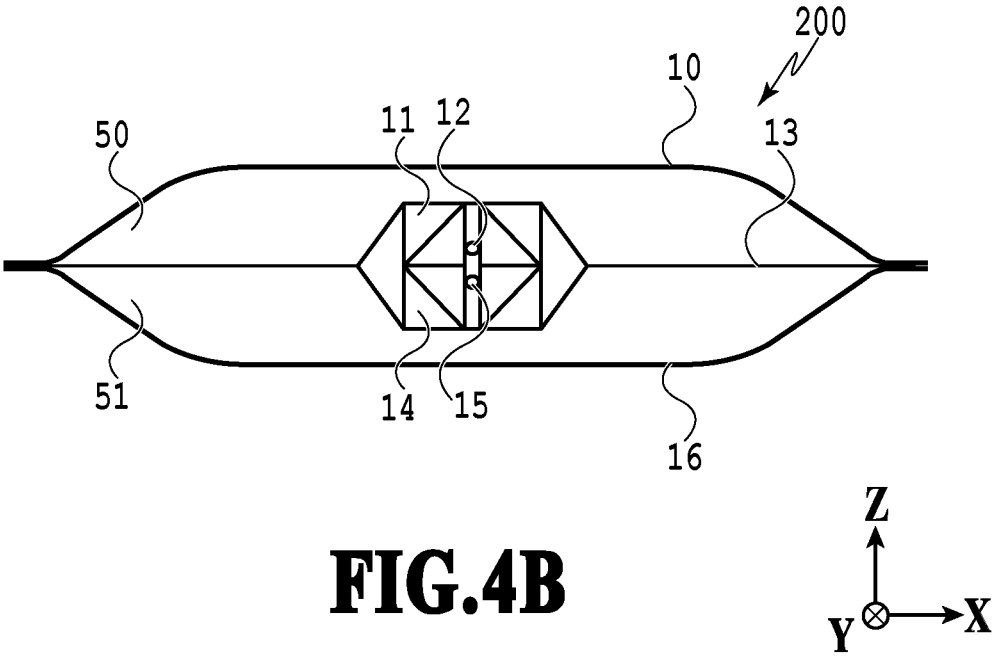

FIG. 3 is a plan view showing a configuration of the liquid storage container 200 of the present embodiment. FIGS. 4A and 4B are views showing cross-sections of the liquid storage container 200. FIG. 4A is a cross-sectional view taken along the IVA-IVA sectional line in FIG. 3. FIG. 4B is a cross-sectional view taken along the IVB-IVB sectional line in FIG. 3. Now, a description will be given below with reference to FIGS. 3 to 4B. In FIG. 3, reference signs P1, P2, and P3 denote regions in the liquid storage container 200 divided into three parts almost evenly from the liquid supply port 17 side. A region adjacent to the liquid supply port 17 is defined as a region P1, a central region of the liquid storage container 200 is defined as a region P2, and a region located most distant from the liquid supply port 17 is defined as a region P3.

The liquid storage container 200 of the present embodiment includes a first communication flow channel unit 11 that communicates with a supply unit 18 provided with the liquid supply port 17, and a second communication flow channel unit 14 that also communicates with the supply unit 18. Moreover, the liquid storage container 200 includes a partitioning member 13 that divides a liquid storage chamber to store the liquid containing the precipitating component into a first liquid storage chamber 50 and a second liquid storage chamber 51 in a direction intersecting with the direction of gravitational force. The partitioning member 13 is configured to be sandwiched between the first communication flow channel unit 11 and the second communication flow channel unit 14. According to the above-described configuration, a length in the direction of gravitational force (that is, the height) of each chamber for storing the liquid becomes almost a half as compared to the configuration of the liquid storage container of the same size without provision of the partitioning member 13. In this way, it is possible to reduce a difference in concentration in a direction of precipitation of the liquid. The first liquid storage chamber 50 is formed from the partitioning member 13 and a first flexible film 10. The second liquid storage chamber 51 is formed from the partitioning member 13 and a second flexible film 16.

The partitioning member 13 may be a plate-like hard material that facilitates positioning at the time of manufacturing, or may be a film-like soft material having advantages in terms of a welding performance, an increase in capacity, a low weight, and cost reduction. In order to suppress inhomogeneity of the precipitating component, the partitioning member 13 is preferably arranged in such a way as not to be inclined relative to the horizontal direction in the position attached to the liquid supply unit 105 (FIG. 1).

The first communication flow channel unit 11 includes a first liquid introducing portion 12 to introduce the liquid stored in the first liquid storage chamber 50, and a first flow channel 61 to guide the introduced liquid to the supply unit 18. The second communication flow channel unit 14 includes a second liquid introducing portion 15 to introduce the liquid stored in the second liquid storage chamber 51, and a second flow channel 62 to guide the introduced liquid to the supply unit 18. The supply unit 18 includes a junction 19 where the liquids guided from the first flow channel 61 and the second flow channel 62 are joined together. The liquids joined together at the junction 19 are guided to the liquid supply port 17.

Each of the liquid stored in the first liquid storage chamber 50 and the liquid stored in the second liquid storage chamber 51 may develop concentration distribution of the precipitating component as schematically illustrated in part of FIG. 4A. Specifically, a liquid L having a relatively low concentration is stored in an upper part in the direction of gravitational force while a liquid D having a relatively high concentration is stored in a lower part in the direction of gravitational force.

In the present embodiment, a location of the liquid introducing portion in the first communication flow channel unit 11 and a location of the liquid introducing portion in the second communication flow channel unit 14 are arranged at relatively different positions in the units. To be more precise, both the first liquid introducing portion 12 of the first communication flow channel unit 11 and the second liquid introducing portion 15 of the second communication flow channel unit 14 are provided at positions relatively close to the partitioning member 13. Specifically, the first liquid introducing portion 12 of the first communication flow channel unit 11 located above the partitioning member 13 in the direction of gravitational force (on the anti-gravity side) is provided at a position below (on the gravity side of) a central part in the direction of gravitational force of the first communication flow channel unit 11. The second liquid introducing portion 15 of the second communication flow channel unit 14 located below the partitioning member 13 in the direction of gravitational force is provided at a position above a central part in the direction of gravitational force of the second communication flow channel unit 14. According to this configuration, the first liquid introducing portion 12 introduces the liquid D having the relatively high concentration of the precipitating component, while the second liquid introducing portion 15 introduces the liquid L having the relatively low concentration of the precipitating component. As these liquids are joined together at the junction 19, it is possible to supply the liquid that is improved in homogeneity of the concentration. For example, the position of each of the first liquid introducing portion 12 and the second liquid introducing portion 15 is preferably located at a distance of equal to or above 1.0 mm and equal to or below 3.0 mm relative to the partitioning member 13. Here, the liquid ejecting apparatus 100 is provided with a pump mechanism for suctioning the liquid stored in the liquid storage container 200, and the liquid inside the liquid storage container 200 is sucked into the liquid ejecting apparatus 100 owing to a negative pressure generated by suctioning of the pump mechanism. Meanwhile, the first flexible film 10 and the second flexible film 16 contract in such a way as to stick to the respective communication flow channel units in accordance with the suctioning of the liquid. For this reason, the liquid will hardly remain even if the position of the second liquid introducing portion 15 is located close to the partitioning member 13, for example. Otherwise, the remaining liquid will fall within a negligible range in that case.

In the meantime, the flexible films may stick to the liquid introducing portions as the liquid storage container 200 contracts along with the progress of the supply of the liquid from the liquid storage container 200. As a consequence, the liquid storage container 200 may fail to properly introduce the liquid from each liquid introducing portion. In this regard, each communication flow channel unit is preferably provided with a groove in the vicinity of the liquid introducing portion so as to dispose the liquid introducing portion inside the groove. Meanwhile, it is preferable to keep the liquid introducing portion from directly coming into contract with the flexible film by providing a step or a slit in the vicinity of the liquid introducing portion.

Next, a description will be given of the positions (positions in y direction) to provide the liquid introducing portions in the respective communication flow channel units of the present embodiment. Each liquid introducing portion is provided at a front end on an opposite side of the supply unit 18 (that is, an end portion in +y direction) in each communication flow channel unit. As shown in FIG. 3, the liquid storage container 200 is trisected in a direction (y direction) toward a surface opposed to the liquid supply port 17. The trisected regions are defined as the regions P1, P2, and P3 enumerated from the side close to the liquid supply port 17. In the present embodiment, the front end positions of the first communication flow channel unit 11 and of the second communication flow channel unit 14 are located in the region P2 being the central part. In the case where the front end positions are located in the region P2 being the central part, each front end position is located at a position at a substantially equal distance from every position in the liquid storage container 200. Accordingly, the liquid is supplied almost uniformly from the entire region inside the liquid storage container 200, and the liquid storage container 200 starts contracting from an outer peripheral portion of the container. In this way, it is possible to improve a performance to use up the liquid in the case where each front end position is located in the region P2.

The above-described liquid storage container represents an example in which the first communication flow channel unit 11 and the second communication flow channel unit 14 sandwiching the partitioning member 13 have symmetrical shapes. In the case of supplying the liquids of the uniform concentration, it is preferable to provide the front end positions in y direction of the first communication flow channel unit 11 and of the second communication flow channel unit 14 substantially at equal positions inside the liquid storage container 200 and to provide flow channels substantially at equal lengths as well. On the other hand, the front end positions of the respective communication flow channel units (that is, the lengths of the flow channels) may be provided differently in the case of supplying the liquids of various concentrations, for instance. In other words, the shapes of the first communication flow channel unit 11 and the second communication flow channel unit 14 may be different from each other. In the meantime, the first communication flow channel unit 11 and the second communication flow channel unit 14 may have asymmetric shapes in the case of storing the liquids having different properties into the first liquid storage chamber 50 and the second liquid storage chamber 51, respectively, and then supplying a liquid obtained by mixing the liquids stored therein.

Modified Example

Figure 5A:
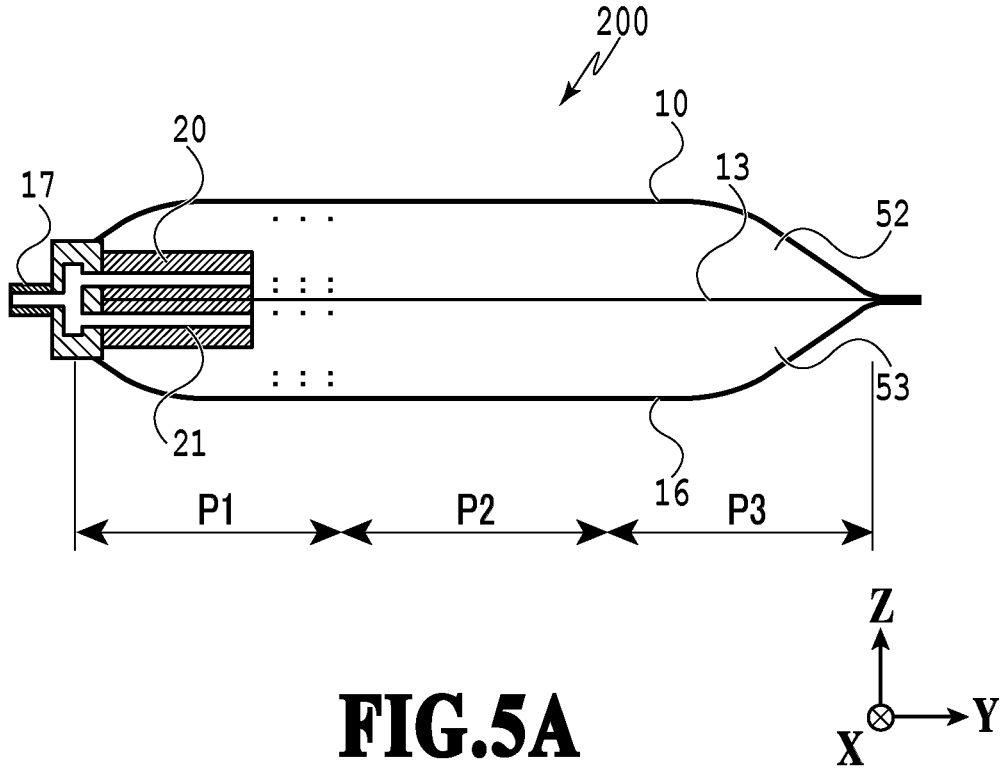
FIGS. 5A and 5B are diagrams showing another example of communication flow channel units.
Figure 5B:
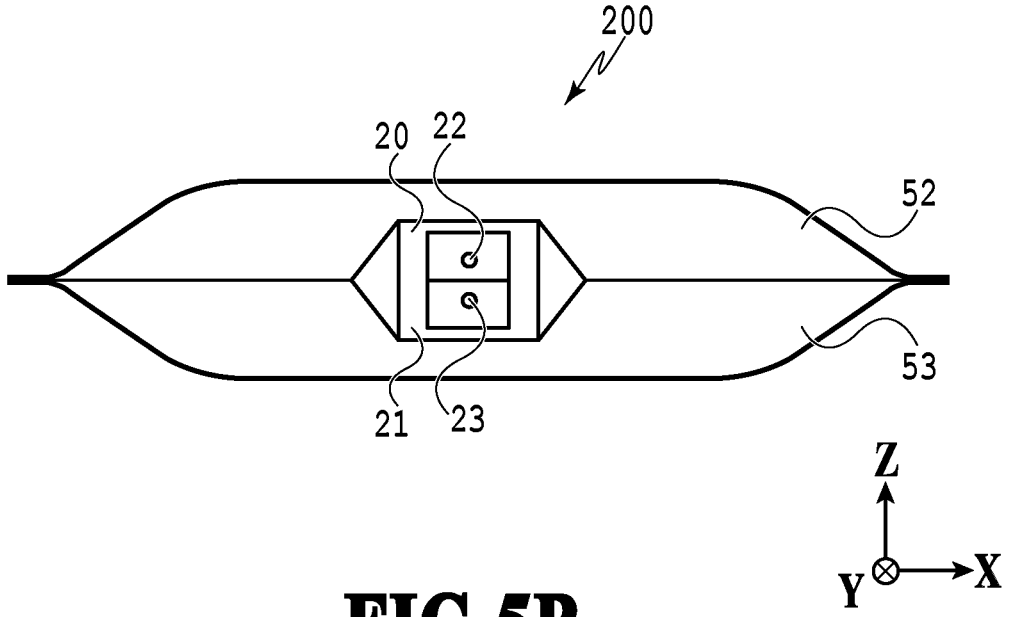

FIGS. 5A and 5B are diagrams showing another example of the communication flow channel units. FIGS. 3 to 4B describe the example in which the front end positions of the respective communication flow channel units are located in the region P2 being the central part. Nonetheless, the front ends may be located at any positions where it is possible to avoid closure of the liquid introducing portions associated with the shrinkage of the liquid storage container. For example, the front ends may be located in the region P1 out of the trisected regions, which is located on the side close to the liquid supply port 17 as shown in FIG. 5A. FIGS. 5A and 5B show an example in which the liquid storage container 200 includes a third communication flow channel unit 20 and a fourth communication flow channel unit 21. The third communication flow channel unit 20 and the fourth communication flow channel unit 21 represent the example in which the front end positions thereof are located on the liquid supply port 17 side as compared to the first communication flow channel unit 11 and the second communication flow channel unit 14. However, even in the case shown in FIGS. 5A and 5B, the front end positions of the third communication flow channel unit 20 and of the fourth communication flow channel unit 21 are preferably located at the positions as close to the region P2 being the central part as possible because these communication flow channel units can thus suction the liquids evenly as discussed earlier. The front end positions may be located in the region P3. In this case, however, the lengths of the flow channels become longer than the cases where the front ends are located in the regions P1 and P2, and this configuration may bring about the occurrence of precipitation inside the flow channels. For this reason, it is preferable to locate the front ends either in the region P2 or in the region P1. In the example of FIGS. 5A and 5B, positions of a third liquid introducing portion 22 of the third communication flow channel unit 20 and of a fourth liquid introducing portion 23 of the fourth communication flow channel unit 21 relative to the partitioning member 13 are located at the same positions as those in the example shown in FIGS. 4A and 4B. In other words, both of the liquid introducing portions are located at positions close to the partitioning member 13.

<Manufacturing Method>

Figure 6:
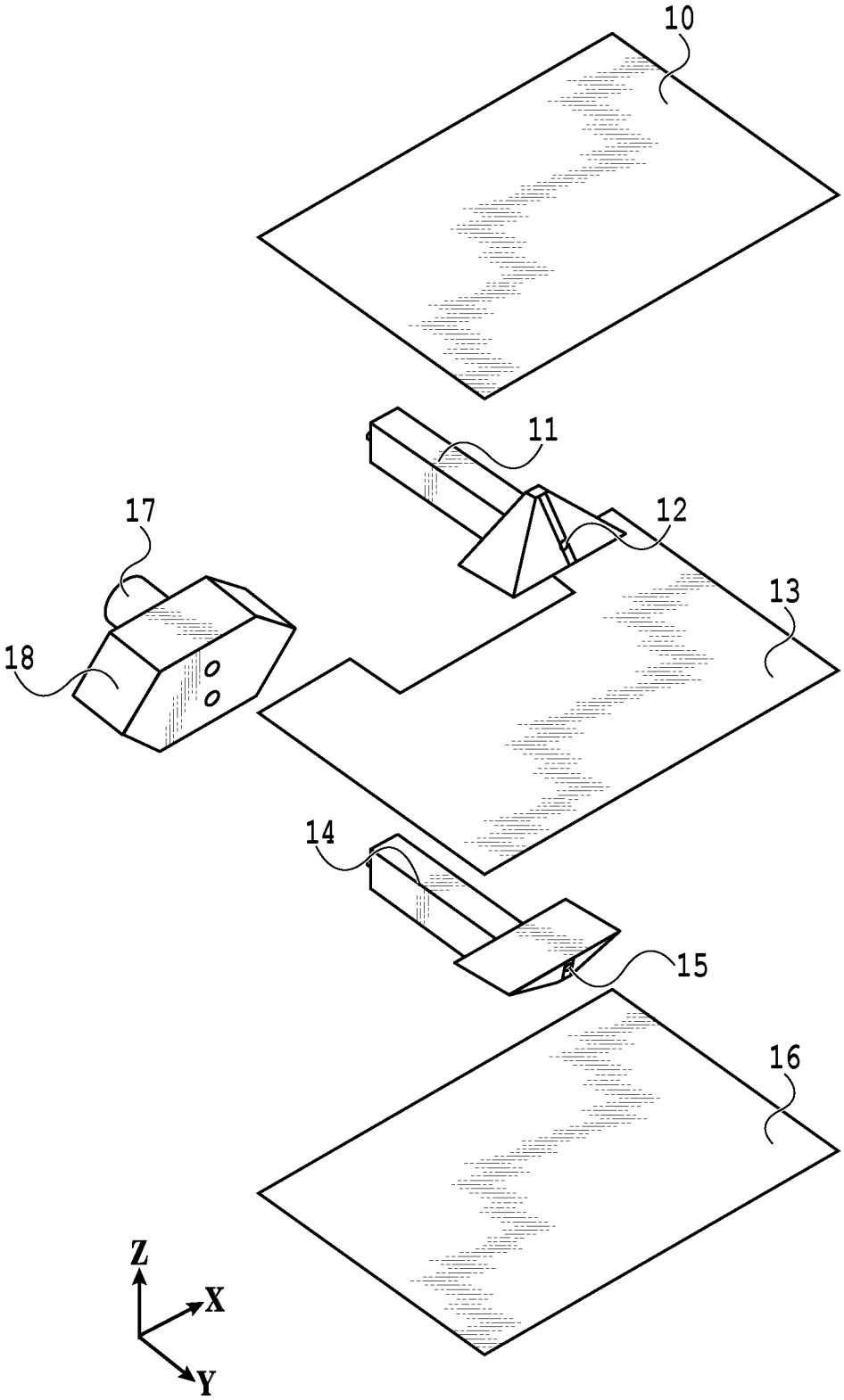
FIG. 6 is an exploded perspective view of the liquid storage container.

FIG. 6 is an exploded perspective view showing an example of respective components in a state before being assembled into the liquid storage container 200 shown in FIGS. 2 to 4B. The liquid storage container 200 includes the liquid supply port 17 that supplies the liquid to a liquid ejecting portion, and the supply unit 18. Moreover, the liquid storage container 200 includes the first communication flow channel unit 11, the second communication flow channel unit 14, the partitioning member 13 for partitioning the liquid storage chamber, and the first flexible film 10 and the second flexible film 16 which are excellent in gas barrier properties. Now, a manufacturing process (an assembly process) of the liquid storage container 200 will be described below. Note that FIG. 6 illustrates a typical structure, and the liquid storage container 200 may also include other structures.

Figure 7:
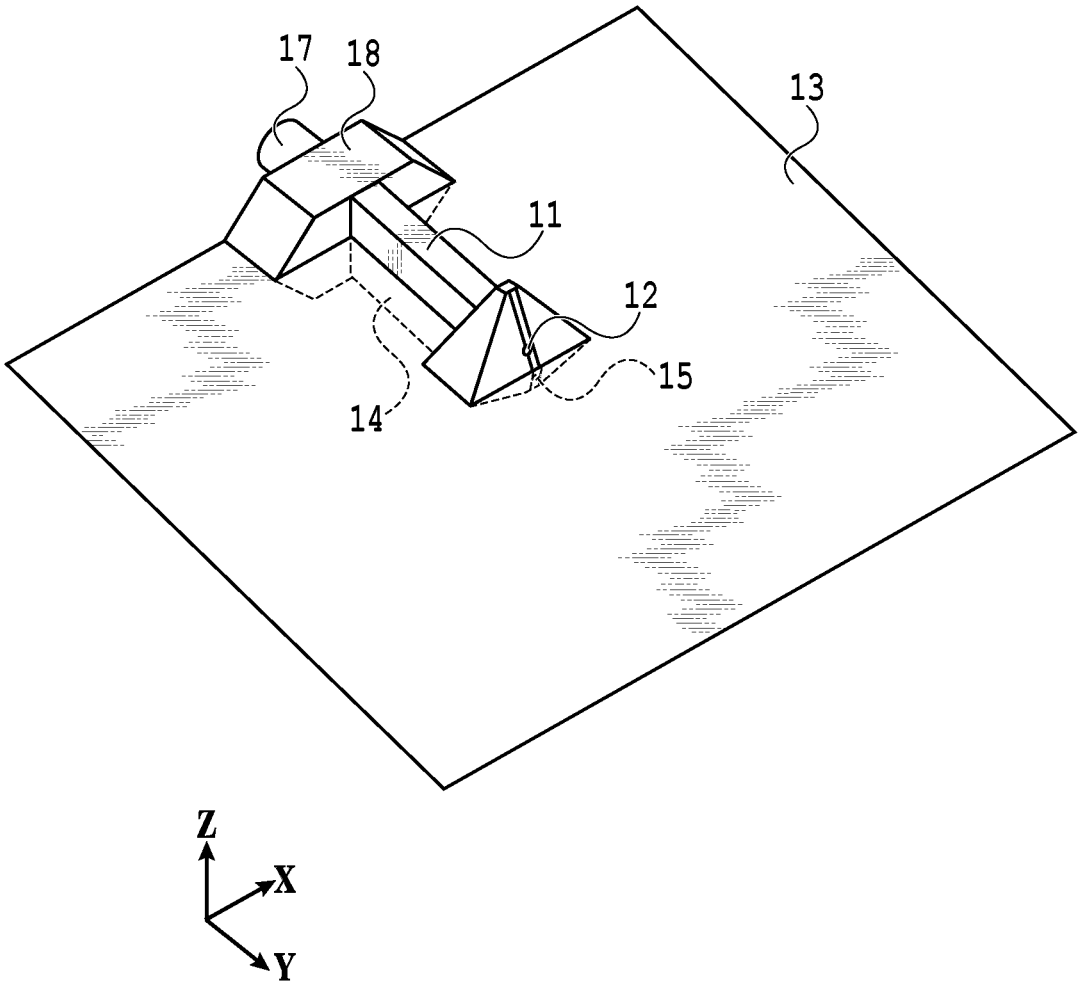
FIG. 7 is a diagram for explaining a method of manufacturing a liquid storage container.
Figure 8:
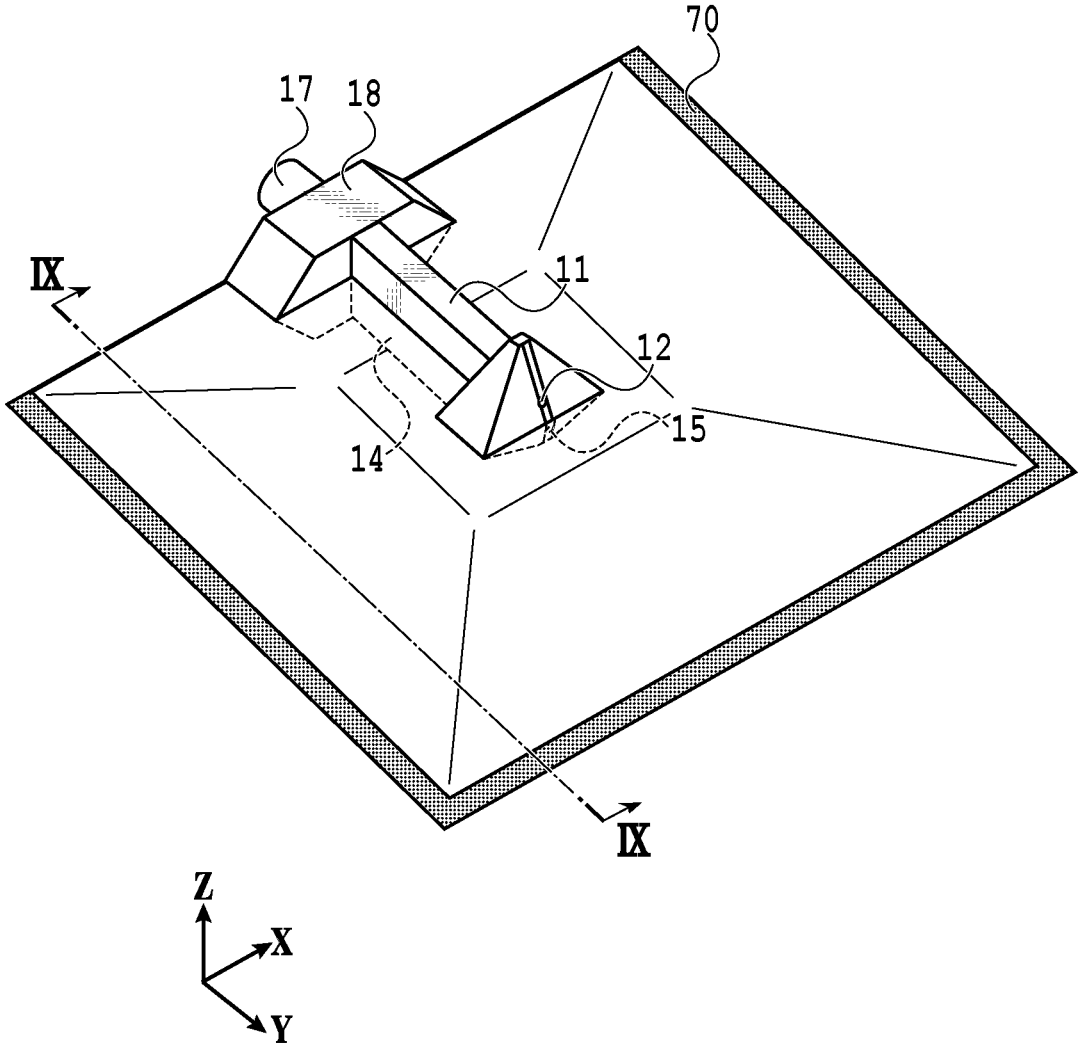
FIG. 8 is another diagram for explaining the method of manufacturing a liquid storage container.
Figure 9:
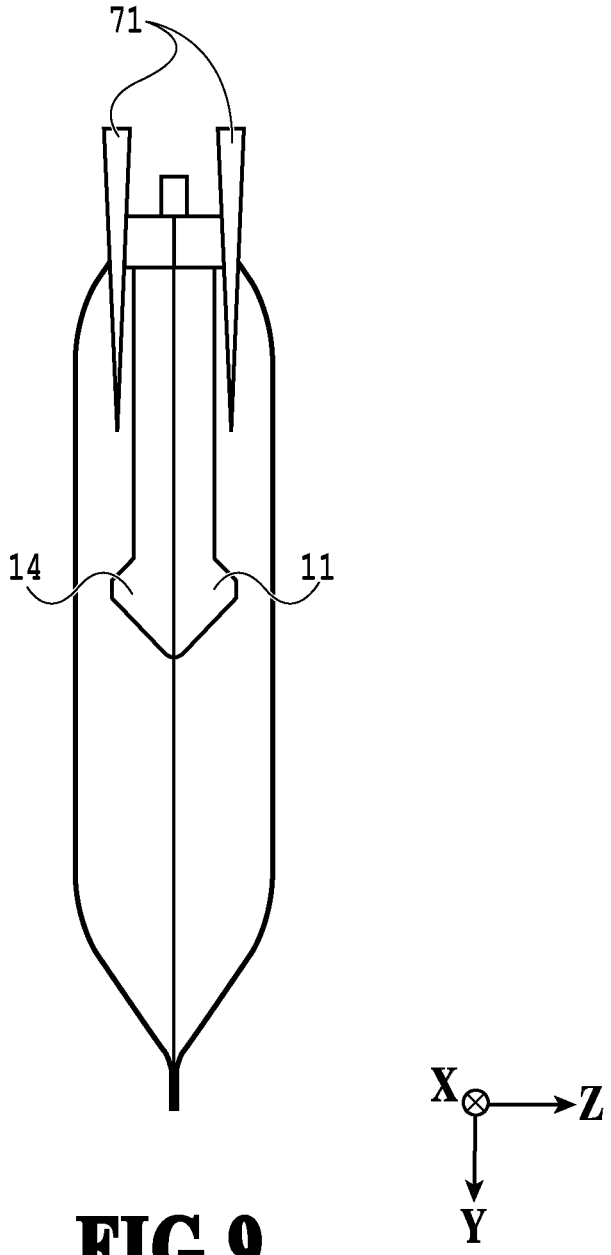
FIG. 9 is another diagram for explaining the method of manufacturing a liquid storage container.
Figure 10:
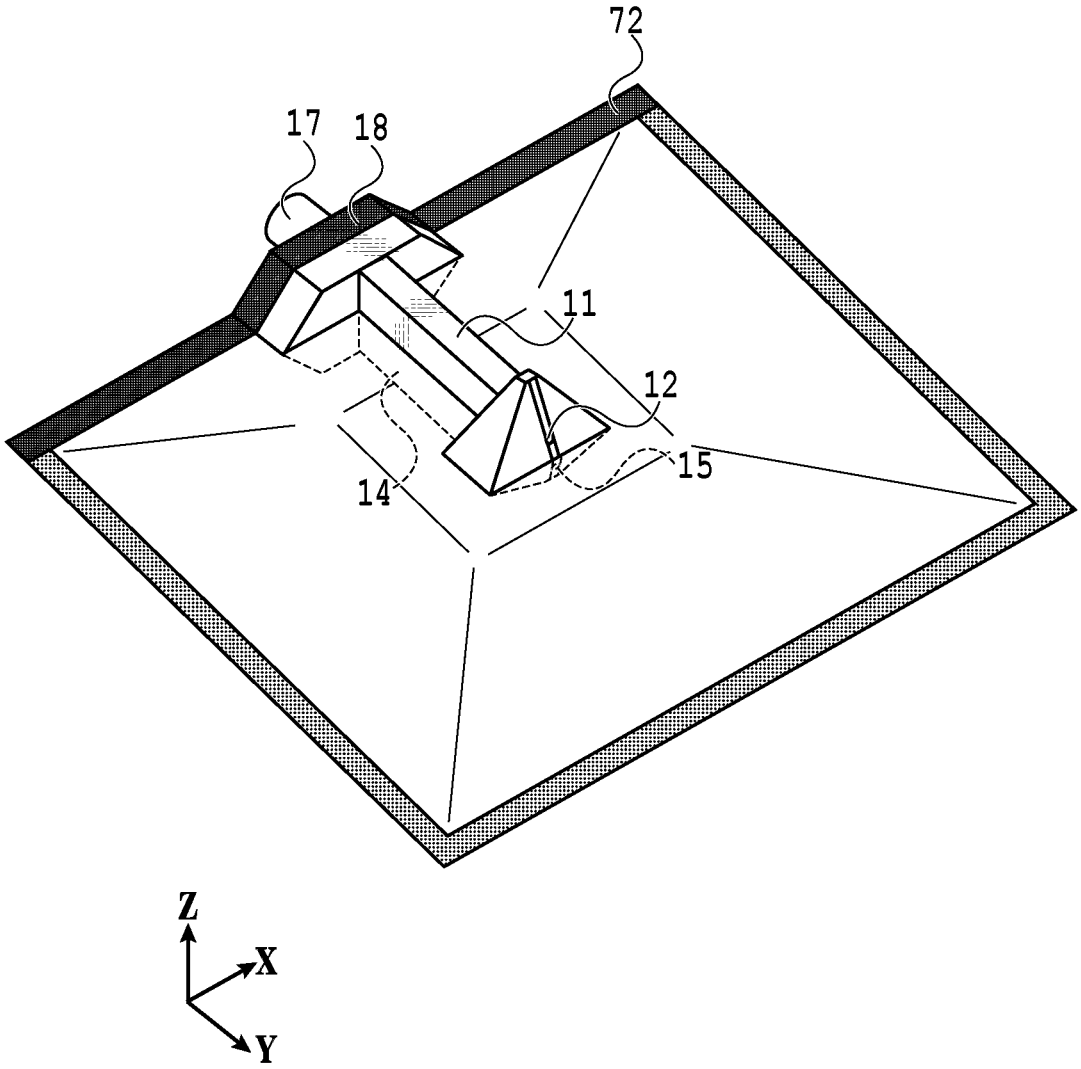
FIG. 10 is another diagram for explaining the method of manufacturing a liquid storage container.
Figure 11A:
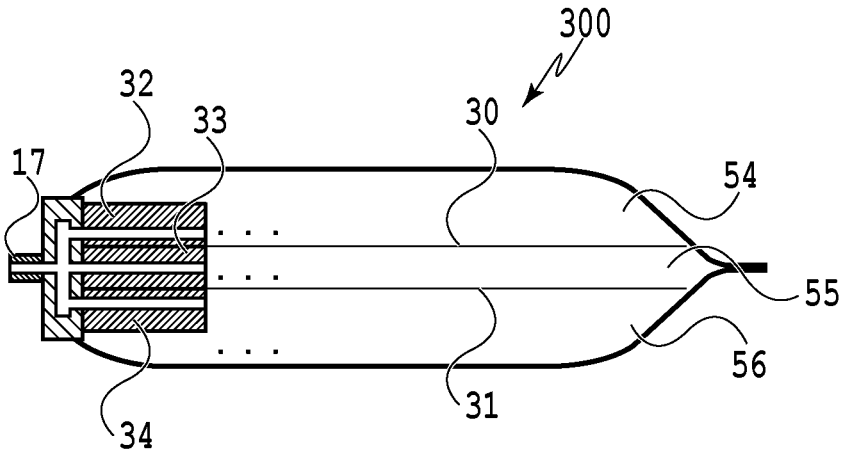
FIGS. 11A and 11B are diagrams showing another example of the liquid storage container.
Figure 11A:
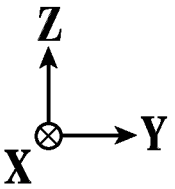
Figure 11B:
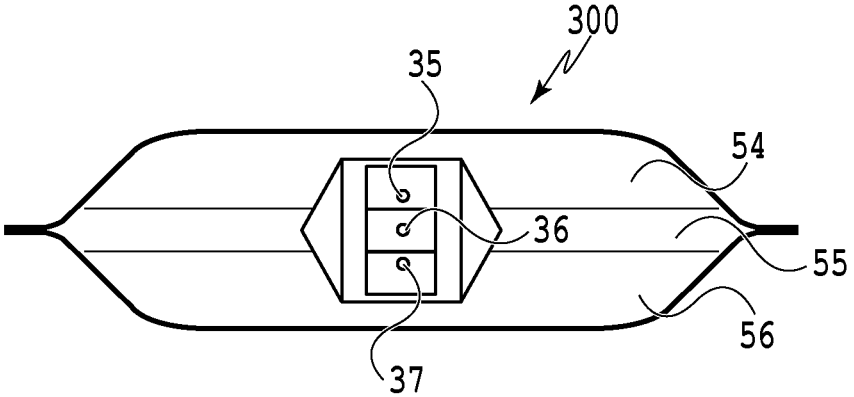
Figure 11B:
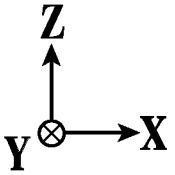

FIGS. 7 to 10 are diagrams for explaining a method of manufacturing the liquid storage container 200. The manufacturing steps are assumed to advance sequentially from FIG. 7 to FIG. 10. FIG. 7 is a perspective view of a manufacturing process of the liquid storage container 200. FIG. 8 is another perspective view of the manufacturing process of the liquid storage container 200. FIG. 9 is a vertical sectional view taken along the IX-IX sectional line in FIG. 8. FIG. 10 is another perspective view of the manufacturing process of the liquid storage container 200.

First, the partitioning member 13 is sandwiched between the first communication flow channel unit 11 and the second communication flow channel unit 14 in the assembly process in FIG. 7. To be more precise, the first communication flow channel unit 11 is located above the partitioning member 13 in the direction of gravitational force and the second communication flow channel unit 14 is located below the partitioning member 13 in the direction of gravitational force. Then, after incorporating the partitioning member 13 in the state of being sandwiched between the respective communication flow channel units, the supply unit 18 is connected to the first communication flow channel unit 11 and the second communication flow channel unit 14. FIG. 7 is the diagram showing the state after the above-mentioned process.

Next, a first welding process is carried out. FIG. 8 is the diagram for explaining the first welding process. An outer periphery of the partitioning member 13 assembled as shown in FIG. 7 is accurately laid over the second flexible film 16. Then, the first flexible film 10 is further laid over the partitioning member 13 accurately. Thereafter, the outer peripheries of the respective flexible films are welded together into a U-shape, thus forming a U-shaped welded portion 70 into a bag-like shape. FIG. 8 is the diagram showing the state after the above-mentioned process.

Next, a liquid injection process is carried out. FIG. 9 is the diagram for explaining the liquid injection process. FIG. 9 is the vertical sectional view taken along the IX-IX sectional line in FIG. 8. In the liquid injection process, liquid injection nozzles 71 are inserted from an unsealed side into the respective liquid storage chambers, and desired amounts of the liquids are injected.

Next, a second welding process is carried out. FIG. 10 is the diagram for explaining the second welding process of sealing the unsealed portion after injecting the liquids. In the second welding process, an upper part of the supply unit 18 and a flexible film upper welded portion 72 are welded and bonded together. Thereafter, the inside of the welded components is deaerated through the liquid supply port 17, and is hermetically sealed by using a not-illustrated plug. Thus, the liquid storage container 200 is manufactured.

As described above, according to the present embodiment, the liquid storage container 200 is divided into the first liquid storage chamber 50 and the second liquid storage chamber 51 in the direction intersecting with the direction of gravitational force by using the partitioning member 13. In this way, it is possible to reduce the height of each liquid storage chamber and to reduce a difference in concentration attributed to the precipitation of the liquid that contains the precipitating component. Moreover, it is possible to supply the liquid at the uniform concentration by locating the liquid introduction portions near the partitioning member. As a consequence, the liquid ejecting apparatus 100 can perform ejection at high quality.

The present embodiment has described the example of the liquid storage container, in which the liquid storage chamber is divided into the first liquid storage chamber 50 and the second liquid storage chamber 51 in the direction intersecting with the direction of gravitational force by using the partitioning member 13. However, the present disclosure is not limited only to this example. In another aspect, two liquid storage containers each provided with a liquid container chamber of a reduced volume in the direction of gravitational force may be stacked on each other, for example.

Second Embodiment

The first embodiment has described the example of the liquid storage container including the two liquid storage chambers. The present embodiment will describe an example of a liquid storage container including three liquid storage chambers.

FIG. 11 is a diagram showing an example of a liquid storage container 300 according to the present embodiment. FIGS. 11A and 11B are cross-sectional views of the liquid storage container 300 sectioned at the same positions as the example described with reference to FIGS. 4A and 4B. The liquid storage container 300 of the present embodiment includes a fifth liquid storage chamber 54, a sixth liquid storage chamber 55, and a seventh liquid storage chamber 56, which are provided in this order from above in the direction of gravitational force. The fifth liquid storage chamber 54 and the sixth liquid storage chamber 55 are divided by using a first partitioning member 30. The sixth liquid storage chamber 55 and the seventh liquid storage chamber 56 are divided by using a second partitioning member 31. A fifth communication flow channel unit 32 is provided to the fifth liquid storage chamber 54. A sixth communication flow channel unit 33 is provided to the sixth liquid storage chamber 55. A seventh communication flow channel unit 34 is provided to the seventh liquid storage chamber 56.

A fifth liquid introducing portion 35 provided to the fifth communication flow channel unit 32 is located at a position close to the first partitioning member 30. A seventh liquid introducing portion 37 provided to the seventh communication flow channel unit 34 is also located at a position close to the second partitioning member 31. On the other hand, a sixth liquid introducing portion 36 provided to the sixth communication flow channel unit 33 is preferably located at the center of the first partitioning member 30 and of the second partitioning member 31 in order to supply the liquid having a uniform concentration. In the meantime, as described in the first embodiment, each liquid introducing portion is preferably located at a region to which the flexible film does not stick even in the case of shrinkage of the liquid storage container 300, and a step or a slit is preferably provided in the vicinity of each liquid introducing portion.

Meanwhile, the front end position in y direction of each communication flow channel unit is located at a position close to the liquid supply port 17. In the liquid storage container 300 of the present embodiment, the sixth liquid storage chamber 55 is sandwiched between the fifth liquid storage chamber 54 and the seventh liquid storage chamber 56. In other words, two sides in the direction of gravitational force of the sixth liquid storage chamber 55 are partitioned by the partitioning members. Accordingly, side surface portions of the sixth liquid storage chamber 55 contract only a little and a space will be formed after the introduction of the liquid. In this case, it is possible to improve the performance to supply the liquids by locating the front end position in y direction of each communication flow channel unit at the position close to the liquid supply port 17.

According to the liquid storage container 300 of the present embodiment, the height of each liquid storage chamber becomes even less than that of the liquid storage container 200 described in the first embodiment in the case where the entire size of the liquid storage container 300 is set about equal to the entire size of the liquid storage container 200 of the first embodiment. Thus, it is possible to supply the liquid at the uniform concentration by further reducing the difference in concentration attributed to the precipitation of the liquid containing the precipitating component.

Figure 12:
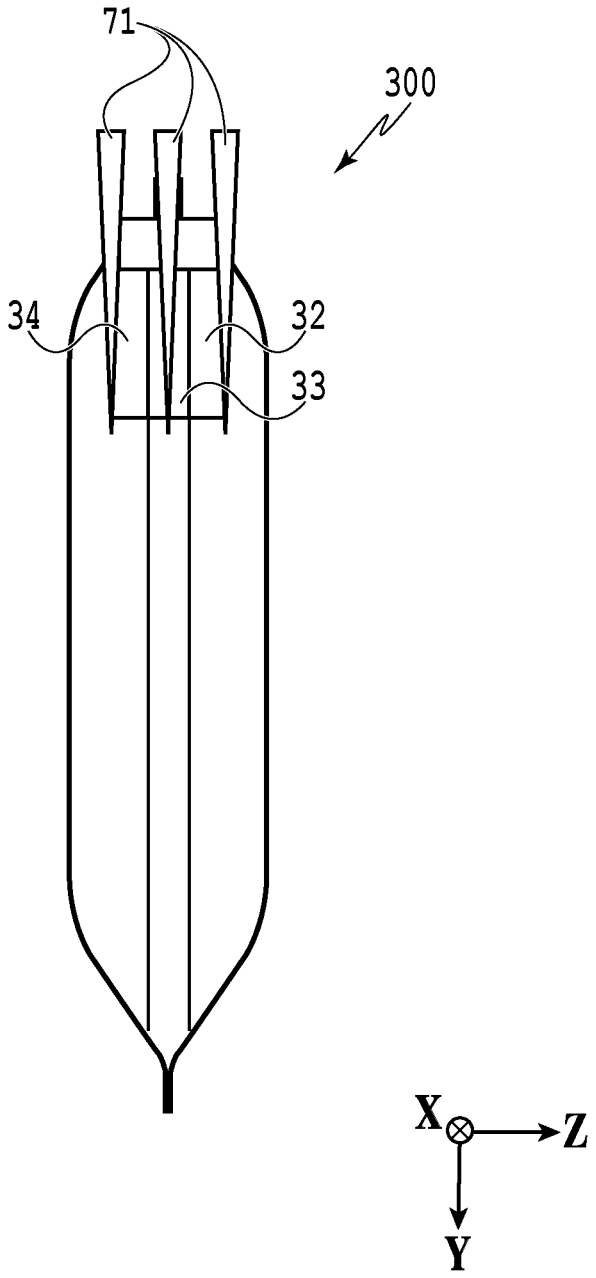
FIG. 12 is a diagram showing another example of the method of manufacturing a liquid storage container.

FIG. 12 is a diagram showing an example of a method of manufacturing the liquid storage container 300 of the present embodiment. As with FIG. 9, FIG. 12 is a diagram showing the liquid injection process. In the present embodiment, the first partitioning member 30 is sandwiched between the fifth communication flow channel unit 32 and the sixth communication flow channel unit 33 in the assembly process. Meanwhile, the second partitioning member 31 is sandwiched between the sixth communication flow channel unit 33 and the seventh communication flow channel unit 34. In the liquid injection process, the liquid is injected into each liquid storage chamber by using one liquid injection nozzle. In the present embodiment, three liquid storage chambers are formed as a consequence of provision of two partitioning members. For this reason, the liquids are injected by using three liquid injection nozzles 71 as shown in FIG. 12.

As described above, the present embodiment can further reduce the height of each liquid storage chamber as compared to the first embodiment. Thus, it is possible to further reduce the difference in concentration attributed to the precipitation of the liquid that contains the precipitating component.

The present embodiment has described the example of the liquid storage container, in which the liquid storage chamber is divided into the three liquid storage chambers in the direction intersecting with the direction of gravitational force by using the two partitioning members. However, the present disclosure is not limited only to this example. In another aspect, three liquid storage containers each provided with a liquid container chamber of a reduced volume in the direction of gravitational force may be stacked on one another, for example.

Third Embodiment

The present embodiment will describe an example in which the liquid introducing portions in the communication flow channel units are different from those of the first embodiment. A description will be given below mainly of different features from those of the first embodiment.

Figure 13:
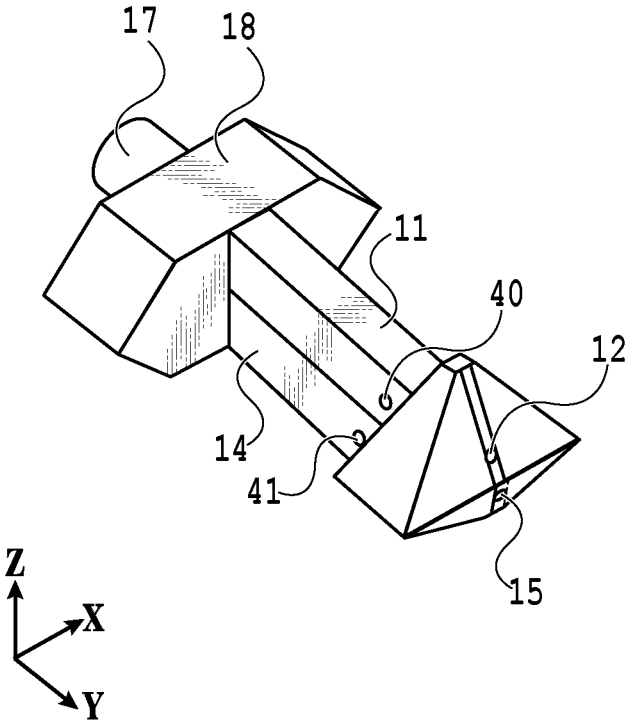
FIG. 13 is a diagram showing communication flow channel units.

FIG. 13 is a diagram for explaining communication flow channel units of the present embodiment. FIG. 13 shows the first communication flow channel unit 11 and the second communication flow channel unit 14 used in the liquid storage container 200 described in the first embodiment. In the present embodiment, the first communication flow channel unit 11 is provided with an eighth liquid introducing portion 40 in addition to the first liquid introducing portion 12. Likewise, the second communication flow channel unit 14 is provided with a ninth liquid introducing portion 41 in addition to the second liquid introducing portion 15.

In the present embodiment, the eighth liquid introducing portion 40 and the ninth liquid introducing portion 41 are provided in side surfaces close to the front ends of the communication flow channel units. Although the example of providing each communication flow channel unit with two liquid introducing portions is illustrated herein, the communication flow channel unit only needs to be provided with at least two liquid introducing portions. Meanwhile, the two or more liquid introducing portions are preferably provided in different surfaces. Each liquid introducing portion is preferably located at such a region to which the flexible film does not stick even in the case of shrinkage of the liquid storage container, or is preferably provided with a step or a slit. In the meantime, the positions in the direction of gravitational force of the first liquid introducing portion 12 and of the eighth liquid introducing portion 40 are preferably located substantially at the same position. Moreover, the positions in the direction of gravitational force of the second liquid introducing portion 15 and of the ninth liquid introducing portion 41 are preferably located substantially at the same position. As described in the first embodiment, the purpose of the above-mentioned configurations is to supply the liquid of the uniform concentration.

According to the present embodiment, it is possible to secure stability of the concentration of the supplied liquid. Moreover, by providing the multiple liquid introducing portions, it is possible to suction the ink that remains in a dead space caused by components of the communication flow channels along with the shrinkage of the liquid storage container as the liquid supply progresses, and thus to improve the performance to use up the liquid.

Although the description of the present embodiment is based on the liquid storage container 200 of the first embodiment, similar liquid introducing portions may be provided to the communication flow channel units of the liquid storage container 300 described in the second embodiment.

Other Embodiments

While the third embodiment has described the example of providing the three liquid storage chambers, it is also possible to adopt a multiple division structure such as a quartering structure within an expectable range of the liquid supply effect. In that case, the positions of the liquid introducing portions of the respective liquid storage chambers may be located at various positions within a satisfiable range of performance of liquid supply. For example, the liquid introducing portion may be located at a position close to the partitioning member in the case of the liquid storage chamber located on an outer side while the liquid introducing portion may be located at a position close to the central part between the adjacent two partitioning members in the case of the liquid storage chamber located on an inner side.

According to the present disclosure, it is possible to supply a liquid stably at a uniform concentration.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-083081, filed May 17, 2021, which is hereby incorporated by reference wherein in its entirety.

What is claimed is:

1. A liquid storage container configured to supply a liquid containing a precipitating component to a liquid ejecting apparatus, comprising:

a partitioning member configured to divide a liquid storage chamber in a direction intersecting a direction of gravitational force;

a plurality of liquid storage chambers divided by the partitioning member; and communication flow channel units provided to the plurality of liquid storage chambers, respectively, and configured to introduce the liquid in the liquid storage chambers and to supply the liquid to the liquid ejecting apparatus, wherein the communication flow channel units include a liquid intake port located at a position closer to the partitioning member than a central part in the direction of gravitational force, and configured to take in the liquid in the liquid storage chambers, wherein the communication flow channel units have a supply port to supply the liquid to the liquid ejecting apparatus, and the supply port and the liquid intake port are located at both ends of the communication flow channel units, and wherein the liquid intake port comprises a plurality of surfaces.

2. The liquid storage container according to claim 1, wherein the liquid storage container is divided into a first liquid storage chamber located above the partitioning member in the direction of gravitational force and a second liquid storage chamber located below the partitioning member in the direction of gravitational force, a first communication flow channel unit provided to the first liquid storage chamber includes a liquid intake port located at a position below a central part in the direction of gravitational force in the first liquid storage chamber and configured to take in the liquid, and a second communication flow channel unit provided to the second liquid storage chamber includes a liquid intake port located at a position above a central part in the direction of gravitational force in the second liquid storage chamber and configured to take in the liquid.

3. The liquid storage container according to claim 1, wherein the liquid intake port is located at a central part of the liquid storage chamber with respect to a direction of taking out the liquid.

4. The liquid storage container according to claim 1, wherein the front end is located at a position closer to the supply unit than a central part of the liquid storage chamber is in a direction from the supply unit to an end portion opposed to the supply unit.

5. The liquid storage container according to claim 1, wherein the liquid intake port is located inside a groove provided to the communication flow channel unit.

6. The liquid storage container according to claim 1, wherein any of a step and a slit is provided near the liquid intake port.

7. The liquid storage container according to claim 1, wherein the liquid storage container is divided by a first partitioning member and a second partitioning member into a first liquid storage chamber located above the first partitioning member in the direction of gravitational force, a second liquid storage chamber located below the first partitioning member in the direction of gravitational force and above the second partitioning member in the direction of gravitational force, and a third liquid storage chamber located below the second partitioning member in the direction of gravitational force, the communication flow channel unit provided to the first liquid storage chamber includes a liquid intake port located at a position below a central part in the direction of gravitational force and configured to take in the liquid, and the communication flow channel unit provided to the second liquid storage chamber includes a liquid intake port located at a central part in the direction of gravitational force and configured to take in the liquid, and the communication flow channel unit provided to the third liquid storage chamber includes a liquid intake port located at a position above a central part in the direction of gravitational force and configured to take in the liquid.

8. The liquid storage container according to claim 1, wherein each of the liquid storage chambers is formed from the partitioning member and a flexible film.

9. A liquid ejecting apparatus comprising:

a liquid storage container configured to store a liquid containing a precipitating component; and a liquid ejecting mechanism configured to eject the liquid supplied from the liquid storage container, the liquid storage container including a partitioning member configured to divide a liquid storage chamber in a direction intersecting a direction of gravitational force, a plurality of liquid storage chambers divided by the partitioning member, and communication flow channel units provided to the plurality of liquid storage chambers, respectively, and configured to introduce the liquid in the liquid storage chambers and to supply the liquid to the liquid ejecting apparatus, wherein the communication flow channel units include a liquid intake port located at a position closer to the partitioning member than a central part in the direction of gravitational force, and configured to take in the liquid in the liquid storage chambers, wherein the communication flow channel units have a supply port to supply the liquid to the liquid ejecting apparatus, and the supply port and the liquid intake port are located at both ends of the communication flow channel units, and wherein the liquid intake port comprises a plurality of surfaces.

10. A method of manufacturing a liquid storage container configured to store a liquid containing a precipitating component comprising: a flexible bag configured to constitute a liquid storage chamber configured to store a liquid, a partitioning member configured to divide an inside of the flexible bag in a direction intersecting a direction of gravitational force so that a plurality of liquid storage chambers are formed so as to be layered in the direction of gravitational force in a state where the partitioning member is attached to a liquid ejecting apparatus, and a plurality of communication flow channel units provided to the plurality of the liquid storage chambers respectively and constituting a liquid path supplying the liquid in each of the liquid storage chambers to the liquid ejecting apparatus, said method of manufacture comprising:

mounting a first communication flow channel unit constituting the liquid path on one surface of the partitioning member and mounting a second communication flow channel unit constituting the liquid path on the other surface of the partitioning member;

performing first welding of welding a flexible film to both surfaces of the partitioning member on which the communication flow channel units are mounted around the partitioning member to form a first liquid storage chamber comprising the first communication flow channel unit and a second liquid storage chamber comprising the second communication flow channel unit;

injecting the liquid by inserting a liquid injection nozzle from a non-welded portion after forming the non-welded portion in which the flexible film is not welded around the partitioning member in the first welding; and performing second welding of welding the non-welded portion to seal the first liquid storage chamber and the second liquid storage chamber after injecting the liquid.

* * * * *